United States Patent [19]

Hamilton et al.

[11] 4,233,829

[45] Nov. 18, 1980

[54] APPARATUS FOR SUPERPLASTIC FORMING

[75] Inventors: C. Howard Hamilton; Neil E. Paton, both of Thousand Oaks; John M. Curnow, Agoura, all of Calif.

[73] Assignee: Rockwell International Corporation, El Segundo, Calif.

[21] Appl. No.: 949,827

[22] Filed: Oct. 10, 1978

Related U.S. Application Data

[62] Division of Ser. No. 839,243, Oct. 4, 1977.

[51] Int. Cl.[3] ..... B21B 9/00

[52] U.S. Cl. ..... 72/38; 72/60; 72/342; 72/364

[58] Field of Search ..... 72/60, 38, 20, 364, 72/342

[56] References Cited

U.S. PATENT DOCUMENTS

| | | | |
|---|---|---|---|
| 2,998,238 | 8/1961 | Kenline | 72/20 |
| 3,340,101 | 9/1967 | Fields et al. | 72/364 |
| 3,934,441 | 1/1976 | Hamilton et al. | 72/60 |
| 3,974,673 | 8/1976 | Fosness et al. | 72/38 |
| 4,023,389 | 5/1977 | Dibble et al. | 72/38 |

*Primary Examiner*—Leon Gilden

*Attorney, Agent, or Firm*—H. Frederick Hamann; Craig O. Malin

[57] ABSTRACT

A method and apparatus are provided for automatically controling the strain rate during superplastic forming of a blank of material into a part. The method and apparatus produce a part in a minimum time by deforming the material in its optimum superplastic conditions. A relationship is determined between time and the pressure required to form the blank against the configured surface of a die at a strain rate which causes the blank to flow superplastically. The blank is positioned in the die and held at a temperature at which the material exhibits superplasticity. Pressure is automatically applied across the thickness of the blank in accordance with the previously determined relationship between time and pressure until the part is formed. The apparatus comprises conduits connected to a die and to a high pressure gas. Valves in the conduits regulate the pressure applied to the blank. A controller receives command signals from a programmer which is programmed with the desired time vs pressure relationship. The controller operates the valves and receives feedback information from a pressure transducer in the conduit to maintain the programmed time vs pressure relationship during the forming operation.

5 Claims, 8 Drawing Figures

APPARATUS FOR SUPERPLASTIC FORMING

This is a division of Patent Application, Ser. No. 839,243 filed Oct. 4, 1977.

BACKGROUND OF THE INVENTION

1. Field of the Invention

This invention relates to the field of material forming, particularly to material forming under superplastic conditions.

2. Description of the Prior Art

Forming methods which are normally used to capitalize on superplasticity in selected materials involve the use of a fluid (preferably gas) pressure to cause sheet material deformation and a configurational die into which the part is formed. Patents have been issued which relate to this process, e.g. U.S. Pat. Nos. 3,340,101 and 3,934,441, and the process is being used increasingly for forming such parts as titanium sheet metal structures for aircraft. In addition to the forming of a single sheet of a superplastic material, other recent processes combine diffusion bonding with superplastic forming to produce complex structures, such as sandwich structures, e.g. U.S. Pat. No. 3,927,817, and reinforced structures, e.g. U.S. Pat. No. 3,920,175.

All of these patents employ fluid pressure forming and rely upon the superplastic properties of the material to achieve high tensile elongations and controlled thinning. Since the elongation and thinning characteristics of the material being formed are related to the rate of straining, the rate of pressure application is critical to the successful fabrication of parts. Prior to this invention, the rate of pressure application was established by a trial-and-error method, resulting in much longer forming times than is possible by controlled strain-rate forming. In addition, it was necessary for an operator to manually manipulate the gas pressure by adjusting pressure valves continually during the forming process. Such a manual method is time consuming and subject to human error, particularly in a manufacturing operation.

Prior art methods were not capable of utilizing optimum forming rates during the entire forming process, resulting in excessively long forming times. Attempts to increase the forming rate resulted in rupturing the part because the strain rate required for superplastic forming was exceeded during critical times in the forming operation. These problems have severely limited the widespread application of the promising method of forming utilizing superplastic properties of some metals and other materials.

SUMMARY OF THE INVENTION

It is an object of the invention to provide a reliable method and apparatus for superplastically forming parts.

It is an object of the invention to provide a method and apparatus for superplastically forming parts utilizing optimum or near optimum forming rates during the entire forming operation so that the time required to form a part is reduced.

It is an object of the invention to provide a method and apparatus for automatically controlling the strain rate during forming of a part.

It is an object of the invention to provide a method wherein the optimum strain rate during superplastic forming of metal and/or plastic parts is determined.

According to the invention, the strain rate of a metal or plastic blank being formed is automatically controlled during the entire forming operation to best utilize the superplastic properties of the material. A relationship is determined between time and the pressure required to form the blank against the configured surface of a die at a strain rate which causes the blank to flow superplastically. The blank is positioned in the die and held at a temperature at which the material exhibits superplasticity. Pressure is automatically applied across the thickness of the blank in accordance with the previously determined relationship between time and pressure until the part is formed. The apparatus comprises conduits connected to a die and to a high pressure gas. Valves in the conduits regulate the pressure applied to the blank. A controller receives command signals from a programmer which is programmed with the time vs pressure relationship. The controller operates the valves and receives feedback information from a pressure transducer in the conduit to maintain the programmed pressure vs time relationship during the forming operation.

These and other objects and features of the present invention will be apparent from the following detailed description, taken with reference to the accompanying drawings.

DESCRIPTION OF THE PREFERRED EMBODIMENT

Superplastic forming requires a material which is capable of exhibiting an effective value of strain rate sensitivity. Strain rate sensitivity is defined by the following classical equation:

$$\sigma = K\dot{\epsilon}^m,$$

where:

m = the strain rate sensitivity, $\sigma$ = stress, $\dot{\epsilon}$ = strain rate, and K = a constant.

The higher the value of m, the higher the tensile elongation (in the absence of strain hardening) and for m values in excess of 0.3 the extended ductility is referred to as superplasticity. Thus, for a material to be capable of superplastic forming, it must be capable of exhibiting an m greater than 0.3 (termed an effective value of strain rate sensitivity).

The value of m is also a function of temperature, material, and microstructure, as well as of strain rate. Therefore, wide ranges in the value of m and the corresponding elongations can be developed for a given material as the rate of deformation changes. In studies of superplastic deformation under biaxial stress conditions such as bulging, the uniformity of thinning was shown also to correlate with the value of m. According to the present invention, an optimum or suitable strain rate is determined and this strain rate is automatically controlled throughout the forming cycle to maintain sufficiently high values of m so that forming times are minimized, rupture eliminated, and thinning reduced.

Figure 1:
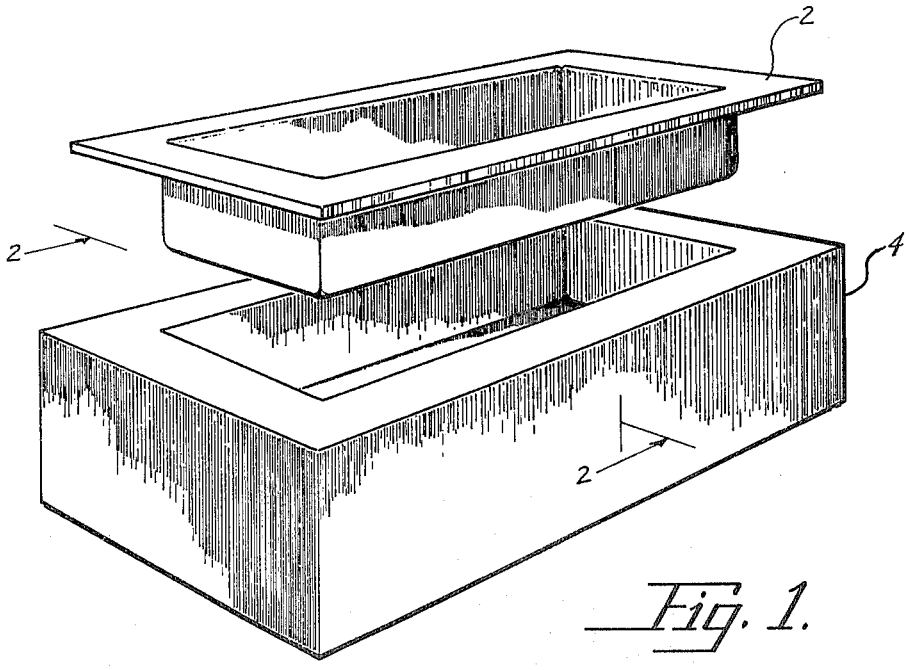
FIG. 1 is an exploded perspective view of a rectangular shaped part used as an example to illustrate the method and the die used to form the part.

FIG. 1 is an exploded perspective view of a rectangular part 2 and a die 4 used to illustrate the principles of the invention. As is usual in the superplastic forming of metals, a metal blank and die are heated to a temperature at which the material exhibits superplastic properties. Gas pressure is applied to one surface of the blank causing the blank to flow into the die cavity and form against the die walls.

Figure 2:
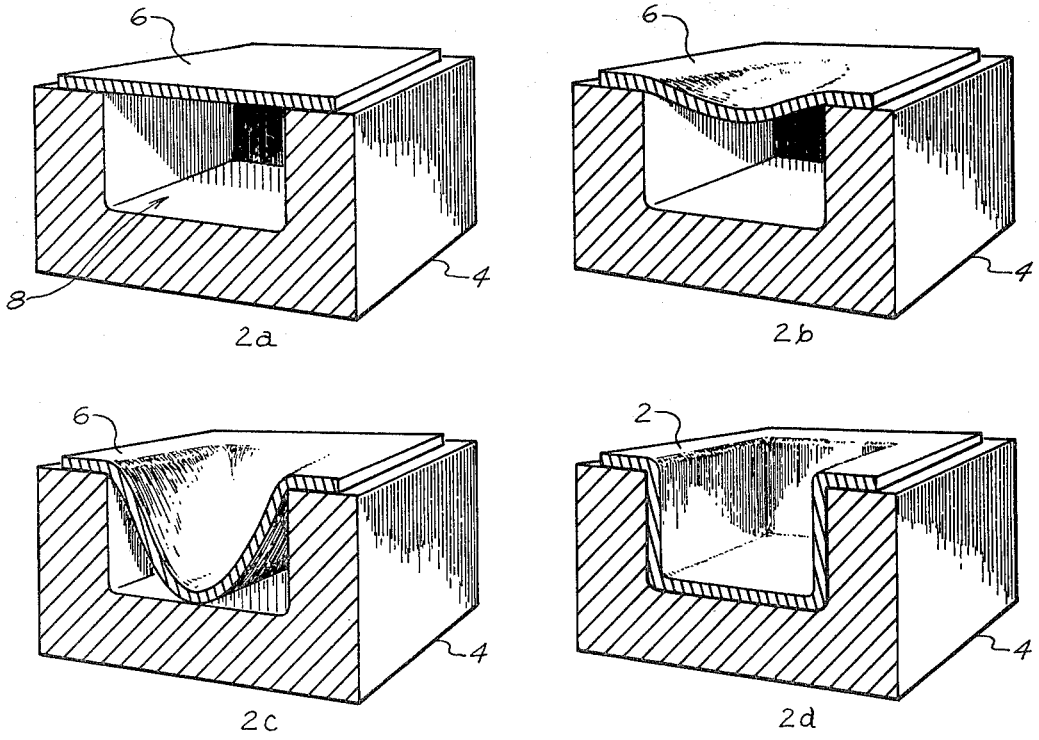
FIG. 2 shows the cross section of a die and a blank at several different stages in the superplastic forming procedure.

FIG. 2 illustrates different forming stages as blank 6. stretches into different shapes and comes into contact with the configured walls of die cavity 8. FIG. 2A shows a blank 6 positioned over die cavity 8 prior to forming. Gas pressure is applied to the top of blank 6 in a manner well known in the art causing the blank to flow into the cavity. During the first stages of forming, the blank is bulged freely into the cavity as shown in FIG. 2B. Eventually, the bulged portion of the blank touches the bottom of the die cavity as shown in FIG. 2C. The die bottom then supports a portion of the blank, greatly changing the stress distribution in the blank. At the final stage of forming, the blank 6 is formed in contact with the walls of the die cavity forming the part 2 as shown in FIG. 2D.

According to the present invention, the pressure applied to form blank 6 is automatically varied during the forming operation to provide an optimum strain rate at all stages of the forming cycle. Since the shape and location of blank 6 is continuously changing, the applied pressure must also be changed continuously to provide an optimum strain rate. In most parts, the strain rate may vary from location to location, and the optimum or desired strain rate will generally be controlled for critical location of the part. This requires that a relationship be determined between time and the pressure required to form the blank against the surface of the die at a strain rate corresponding to the effective value of strain rate sensitivity, at least in the critical location of the part. The pressure vs time profile may be determined analytically, experimentally, or by a combination of analytical and experimental methods.

Figure 3:
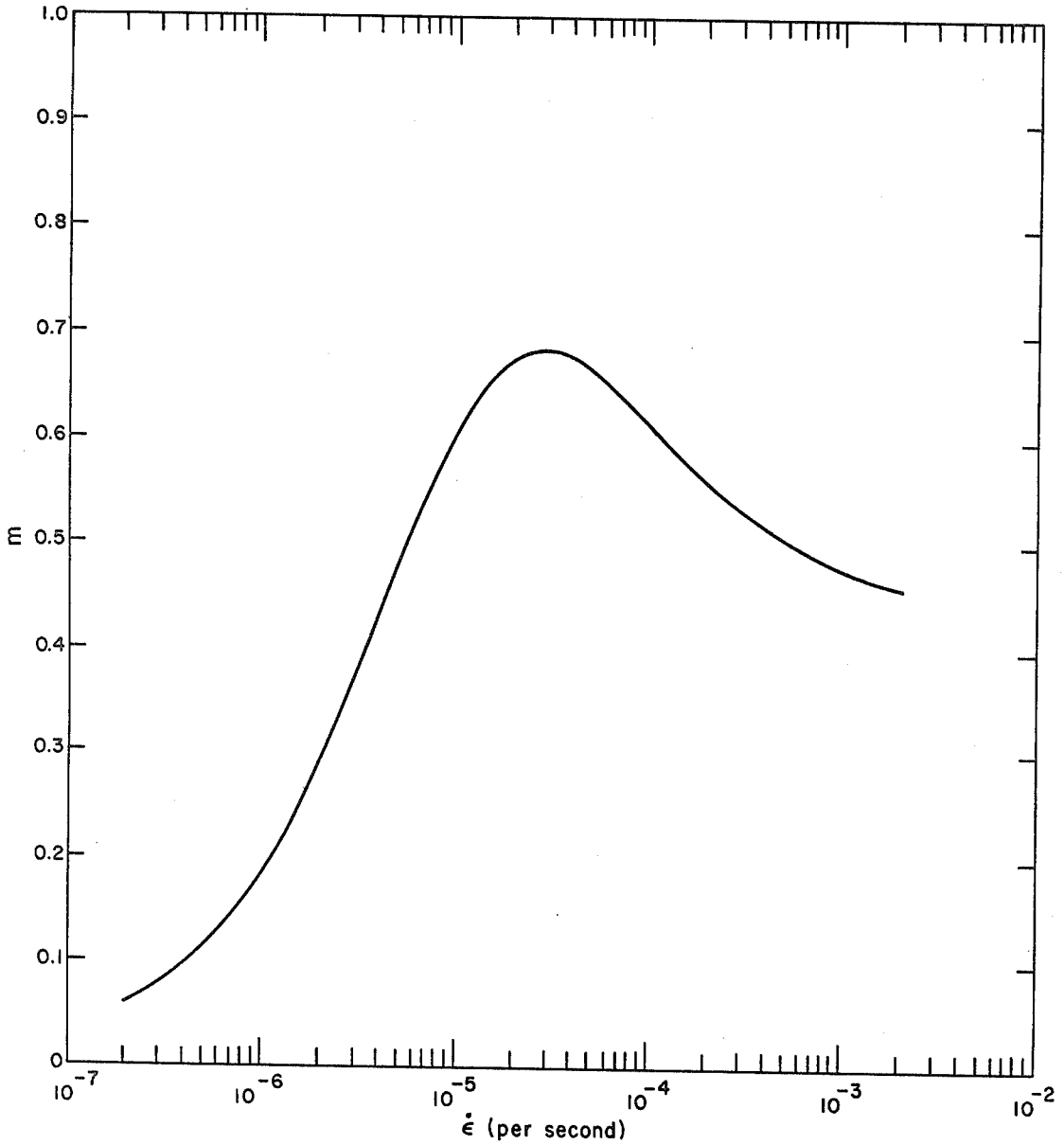
FIG. 3 is a curve showing the relationship between strain rate sensitivity, m, and strain rate, $\dot{\epsilon}$, for the titanium alloy, Ti-6Al-4V, obtained at 1600° F.

An example of an analytical method is presented in the following. To obtain a strain rate which provides an effective value of strain rate sensitivity, a relationship between strain rate sensitivity, m, and strain rate, $\dot{\epsilon}$, is obtained. FIG. 3 shows such a relationship for a titanium alloy (Ti-6Al-4V) obtained at 1600° F. Methods for determining such relationship are well known, e.g., "Determination of Strain Hardening Characteristics by Torsion Testing," by Fields and Backofen, published in the Proceedings of the A.S.T.M., 1957, Vol. 57. Using a relationship such as shown in FIG. 3, a strain rate, $\dot{\epsilon}$, is selected which will provide a high value of strain rate sensitivity, m, preferably over 0.5.

Figure 4:
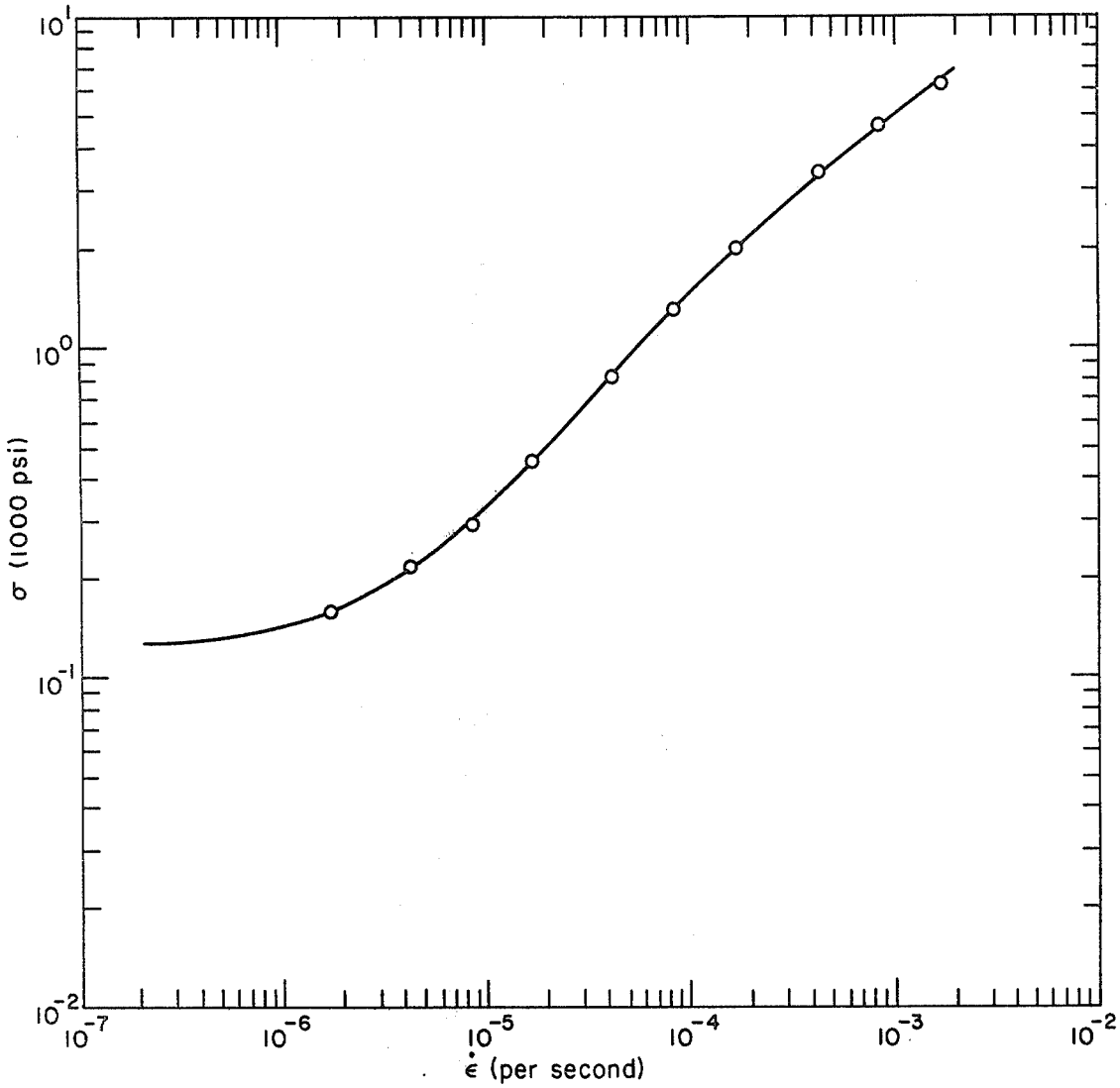
FIG. 4 is a curve showing the relationship between flow stress, $\sigma$, and strain rate, $\dot{\epsilon}$, at 1600° F.

A relationship is then obtained between flow stress, $\sigma$, and strain rate, $\dot{\epsilon}$, at the forming temperature, as shown in FIG. 4. Such relationship can be obtained by stressing standard samples and measuring the resulting strain rate. The flow stress, $\sigma$, required to maintain the selected strain rate, $\dot{\epsilon}$, is determined from this relationship.

The selected flow stress is then used in conjunction with the geometry of the particular part to determine the relationship between time and pressure (the time vs. pressure profile) for forming the particular part. Two methods of determining the time vs pressure profile can be used.

For parts having a simple geometry, such as rectangular part 2, the relation between flow stress and pressure required to obtain the flow stress can be calculated during various stages of forming utilizing known mathematical relationships between pressure and stress in the part having the particular geometry. The following is an example of such a calculation for a rectangular part such as shown in FIGS. 1 and 2 having sufficient length to develop plane strain conditions within the center regions. The end effects are not considered in this analysis since experience has shown that the center area is most critical to successful forming. It is assumed that the material properties do not change substantially during the forming cycle, and therefore a constant effective strain rate, $\dot{\bar{\epsilon}}$, can be sustained if a constant effective flow stress, $\bar{\sigma}$, is generated in the forming diaphragm during the forming. If the von Mises criterion is assumed valid for these materials, the effective stress and strain rates are defined as follows for the plane strain condition:

$$\bar{\sigma} = \frac{1}{\sqrt{2}}\{(\sigma_r - \sigma_\theta)^2 + (\sigma_\theta - \sigma_z)^2 + (\sigma_z - \sigma_r)^2\}^{\frac{1}{2}} = \frac{\sqrt{3}}{2}\sigma_\theta \quad (1)$$

$$\dot{\bar{\epsilon}} = \frac{\sqrt{2}}{3}\{(\dot{\epsilon}_r - \dot{\epsilon}_\theta)^2 + (\dot{\epsilon}_\theta - \dot{\epsilon}_z)^2 + (\dot{\epsilon}_z - \dot{\epsilon}_r)^2\}^{\frac{1}{2}} = \frac{2}{\sqrt{3}}\dot{\epsilon}_r \quad (2)$$

where r, $\theta$, z=subscripts denoting coordinate directions, $\dot{\epsilon}$=strain rate, $\sigma$=flow stress, and $\dot{\epsilon}_r+\dot{\epsilon}_\theta+\dot{\epsilon}_z=0$ (plane strain).

In order to maintain constant effective stress, it is necessary to impose sufficient gas pressure to develop the constant stress, $\sigma_\theta$. If it is assumed that the following diaphragm will maintain a cylindrical shape in those areas not contacting the die, and that the forming diaphragm is thin relative to the radius of curvature, the gas pressure P can be expressed in terms of the stress $\sigma_\theta$ (and therefore):

$$P_i = t_i\sigma_\theta/\rho_i = 2t_i\bar{\sigma}/\sqrt{3}\rho_i \quad (3)$$

where p=radius of curvature, t=thickness of the diaphragm, and i=a subscript denoting the stage of forming.

The radius of curvature can be expressed in terms of the height of the forming part or section, $y_i$, and the half-width of the part or forming section, $x_i$:

$$\rho_i = y_i^2 + x_i^2/2y_i \quad (4)$$

Figure 5:
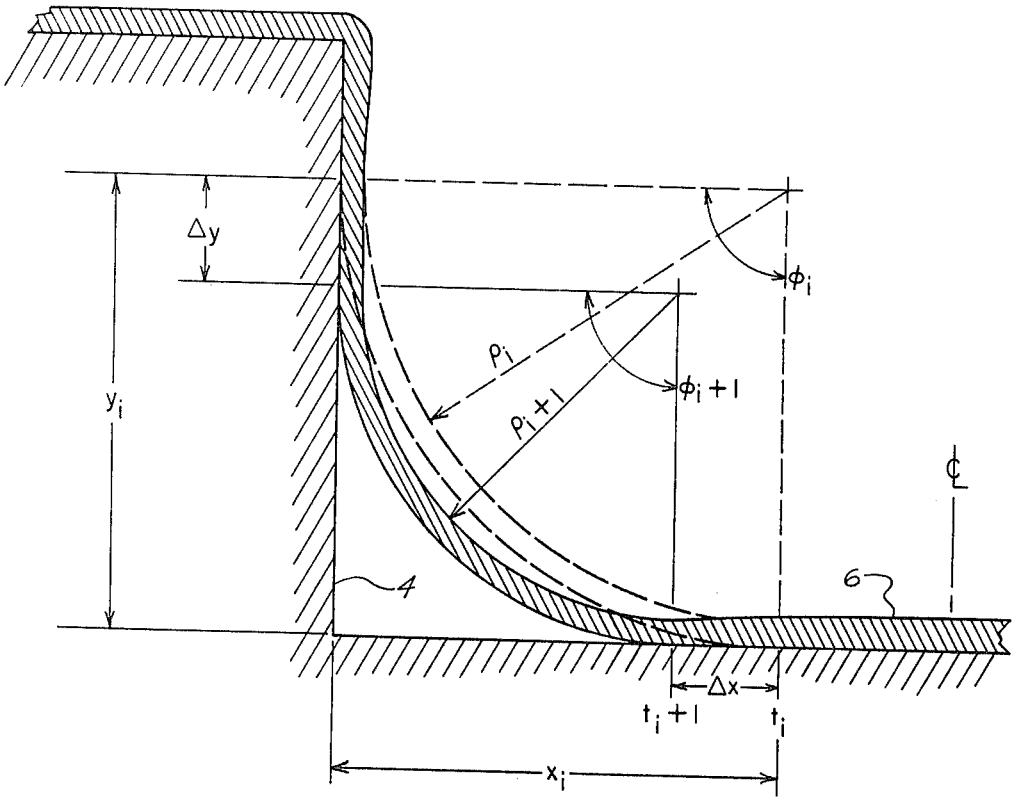
FIG. 5 is a thickness profile for a rectangular-shaped part during superplastic forming at 1600° F.

In order to compute the thickness, $t_i$, it is assumed that no sliding occurs between the part and the die, and the deformation occurs only in the cylindrical section. Therefore, a step-wise change in thickness can be determined as illustrated in FIG. 5:

$$t_{i+1} = \frac{t_i(\rho_i\phi_i - \frac{\Delta y}{2} - \frac{\Delta x}{2})}{\rho_{i+1}\,\phi_{i+1} + \frac{\Delta x}{2} + \frac{\Delta y}{2}}; \quad (5)$$

where:

$\phi = 2\tan^{-1} y_i/x_i$, and $\Delta x$, $\Delta y$ = length of the step increments of the x and y axis.

By combining Eqn. (3), (4), and (5), the pressure necessary to sustain constant effective stress, and therefore constant strain rate, can be established provided the extent of forming to a given time is known.

In order to arrive at the extent of forming as a function of time, it is recognized that constant strain rate has been induced throughout the forming cycle. Therefore, the time, $\tau_i$, lapsed to reach a given amount of effective strain, $\bar{\epsilon}$, is:

$$\tau_i = \bar{\epsilon}/\dot{\epsilon}. \quad (6)$$

The effective strain developed to any stage, i, of the forming process is readily determined for the plane strain condition from $$\bar{\epsilon} = 2/\sqrt{3}\,\epsilon_r \quad (7)$$

where $\epsilon_r = \ln(ti/to)$, $t_o$ is starting thickness, and $t_i$ is given by Eqn. (5). Thus, the pressure profile can be readily constructed by computing a series of values of $P_i$ from Eqn. (3) and corresponding $\tau_i$ from Eqn. (6) for any predetermined strain rate, $\dot{\epsilon}$, and corresponding flow stress, $\sigma$.

This analytical model can be computer programmed to provide the pressure vs time profile for a rectangular shaped die of general dimension and for a superplastic sheet material for which the flow stress at a desired strain rate is known. Generally the strain rate selected is that value corresponding to a high m value (e.g., generally in excess of 0.5).

Figure 6:
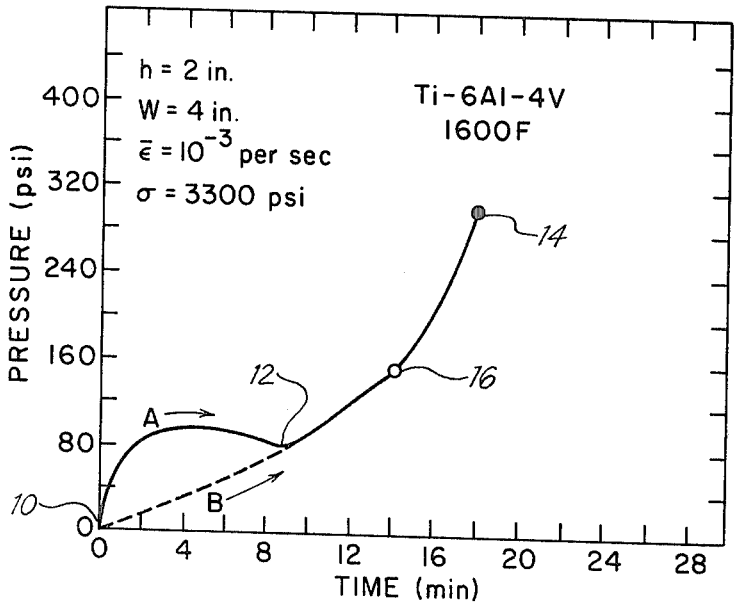
FIG. 6 is the pressure vs time profile used for forming the blank shown in FIGS. 1 and 2 at 1600° F.

The pressure profile resulting from this model is illustrated by profile A in FIG. 6 for a part in which the ratio of the width (w) to height (h) of the formed part (w/h) is 2. The first part of this profile is typified by a rapidly increasing then decreasing rate of pressure application. The reason for the shape of this curve is due to the changing radius and thickness as shown in Eqn. (3).

As the radius decreases, an increase in pressure is demanded to maintain a constant flow stress, but a counterpoising effect is caused as the thickness decreases. Initially, the rate of change of the radius is much greater than the rate of change of the thickness, and a pressure increase is required. As forming of the diaphragm continues, the rate of change of thickness increases while that of the radius decreases, and pressure must be reduced to sustain the constant flow stress. Once the diaphragm contacts the base of the die cavity, the rate of change of the radius again dominates, and a rapid pressure increase is required.

Figure 7:
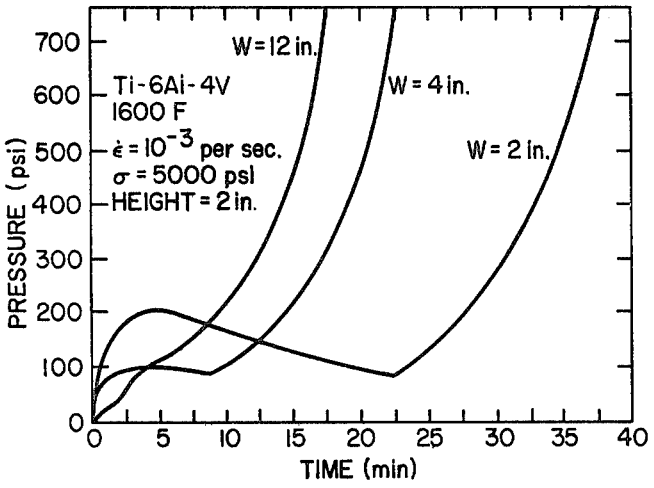
FIG. 7 shows three pressure vs time profiles for forming rectangular shaped parts having different width-to-height ratios.

This trade-off between changing thickness and radius of curvature is strongly dependent on the w/h ratio, and the corresponding pressure profiles can be quite different in reflection of this. An example of the influence of changing width on the pressure profile is illustrated in FIG. 7. In this example, all parameters other than the width were maintained constant. For the narrow, deep part in which w=2 (w/h=1), a significant portion of the profile involves decreasing pressure. This reflects the significant deformation which occurs after the half cylinder section is formed and before the diaphragm contacts the die bottom. During this part of the forming sequence, the radius of curvature is constant but the thickness is decreasing. Once the die bottom is contacted, the pressure rises rapidly, a common characteristic of each of the profiles shown.

For a wide part of w=12 (w/h=6) the pressure rises throughout the profile. This occurs because the forming diaphragm contacts the die bottom before the thinning dominates the process, and a decrease in pressure is not required. For the part of w=4 (w/h=2), the profile is identical in shape to that shown in FIG. 6 and for the same reasons as previously discussed.

FIG. 6 is related to FIG. 2 in that point 10 is the start of forming (FIG. 2A), point 12 is the time when the blank first touches the floor of the die cavity (FIG. 2C), and the point 14 is the end of forming (FIG. 2D).

Profile B of FIG. 6 is an example of the prior art where the pressure/time relation was established by arbitrarily increasing the forming pressure gradually at the lower pressure levels. The part formed according to profile B, ruptured at point 16, well before completion of forming, thus indicating the importance of utilizing a strain rate which is properly controlled throughout the forming operation to maintain the blank in a superplastic condition.

The time vs pressure profile can be calculated for other relatively simple shapes and combinations of simple shapes provided that an accurate mathematical relationship is known for calculating the pressure required to give the desired flow stress for the changing configuration of the blank. For more complex shaped parts, the strains can be experimentally determined by marking a grid on the blank and measuring the grid dimensions at various stages of the forming sequence. The strains required to form the blank to the various stages and corresponding strain rates can be determined from the changing grid dimensions in a manner well known to those skilled in the material and metal forming art.

Likewise, the pressure required at any time to sustain a constant rate of straining for parts which are too complex to be readily analyzed can be determined by experimental test. The strain can be established at a series of forming stages by the gridding technique discussed previously. The time corresponding to each of these strains is then determined by equation (6). The pressure can then be determined experimentally by establishing the pressure to achieve each increment of strain within the predetermined time period, $\Delta\tau$ $$\Delta\tau = \Delta\bar{\epsilon}/\dot{\epsilon} \quad (8)$$

and $\Delta\bar{\epsilon}$ is the change in effective strain for the increment of forming being considered.

This technique to determine the incremental strain change can be one of periodic interruption of the forming test for a measurement of the grid, or it can be through the use of electrical indicators placed at required locations in the die surfaces to remotely identify when the forming part contacts those locations. The pressure for each strain increment can then be established by trial until an acceptable strain rate is achieved and the pressure noted.

The pressure profile can then be constructed by sequencing the imposed pressure required to achieve the controlled strain rate within each increment of strain with the time corresponding to the total strain imposed up to that increment.

Whether determined analytically or experimentally, such a pressure vs time profile for a given part will cause the forming operation to be within the predetermined strain rate for all similar parts, provided the geometry, temperature, and material properties are not changed. Thus, once established, these forming parameters will permit the forming of production quantities of parts within minimum risk of tearing or excessive thin-out, and with minimum forming time required.

Factors that determine the pressure profile include temperature of forming, thickness of the sheet, geometry, and specific material properties (i.e. flow stress as a function of strain rate) which may vary from batch-to-batch of a given material. However, once a pressure profile is established for a given part (i.e. fixed geometry), corrections can be readily made for changes in the variables of temperature, thickness, and material properties. For example, the pressure required is a linear function of thickness and flow stress so that the pressure profile can be readily corrected for either of these:

$$P_c=(t_c/t)(\bar{\sigma}_c/\bar{\sigma})P \quad (9)$$

where the subscript c designates the changed conditions imposed, assuming that the strain rate is not to be changed. A change in temperature will result in a change in flow stress, $\bar{\sigma}$, and this effect will therefore be corrected by equation (9) also. In the above case, the time corresponding to each pressure level will remain unchanged provided the desired strain rate is not changed.

In some cases it may be desired to alter the strain rate, as in the case where the required superplastic index, m, occurs at different strain rates in different heats of materials. In this case, a previously determined pressure profile may be corrected by adjusting both pressure and corresponding time. For the new strain rate, $\dot{\bar{\epsilon}}_c$, there will be a new flow stress, $\bar{\sigma}_c$, and the pressure can therefore be adjusted by equation (9). The time corresponding to the new pressure may then be determined by the following:

$$\tau_c=(\dot{\bar{\epsilon}}_c/\dot{\bar{\epsilon}})\tau \quad (10)$$

Thus, once a successful pressure vs time profile is established for a given part configuration, it can be readily adjusted to accommodate changes in temperature, thickness, and material property variations, even for those parts of such complexity as to make analysis difficult or impossible.

It should be noted that this approach to forming will apply equally well to any material which exhibits strain-rate sensitivity of flow stress, such as many metals, thermo-forming plastics, or superplastic intermetallic compounds such as $Ti_3Al$.

Figure 8:
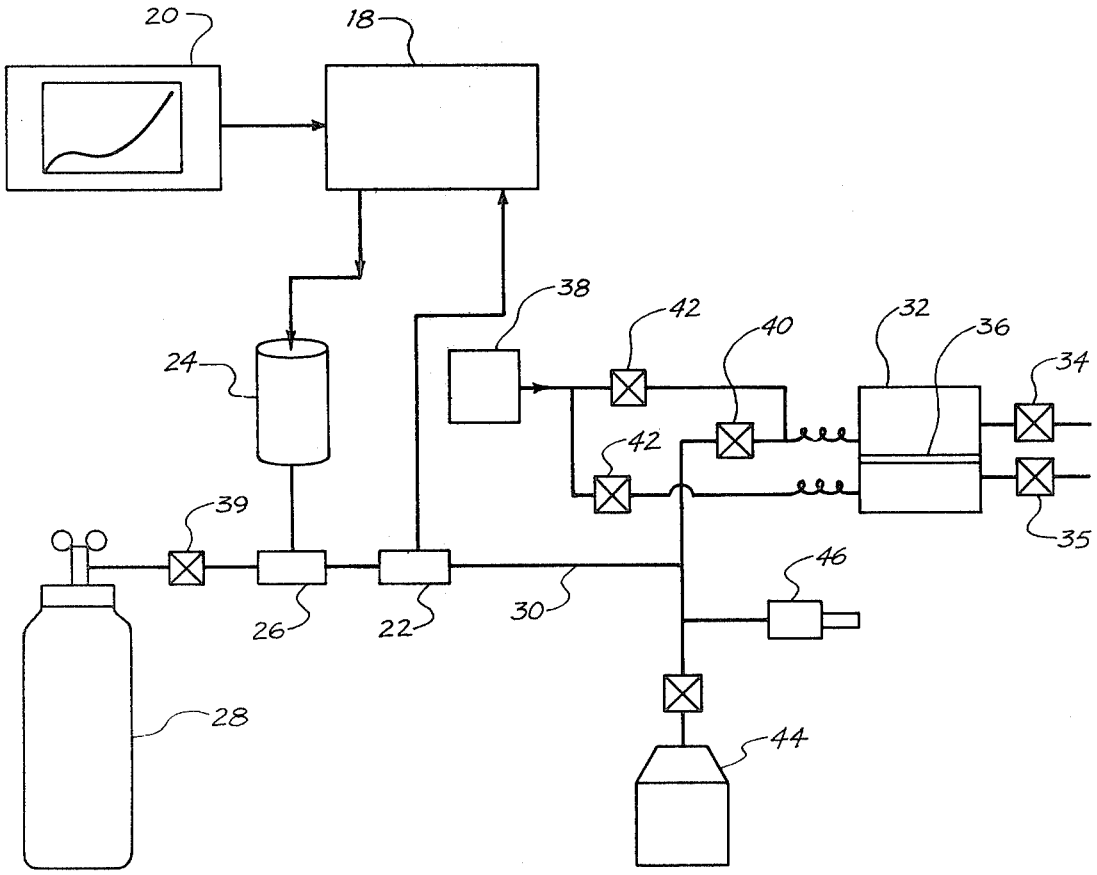
FIG. 8 is a schematic of an apparatus for automatically controlling strain rate during superplastic forming.

FIG. 8 is a schematic of an apparatus for automatically controlling the strain rate during superplastic forming. This apparatus will permit the use of a predetermined pressure profile to be imposed in a superplastic forming process in such a manner as to cause the automatic manipulation of pressure to predetermined levels and at predetermined times during the forming cycle. The apparatus consists basically of a controller 18, profiler or programmer 20, pressure transducer 22, a motor 24 for driving high pressure valve 26, a source of high pressure forming gas 28, conduits 30 for the forming gas, forming dies 32, and exhaust valves 34, 35.

In controlled gas pressure forming of a part, the work piece or blank 36 is installed in the die assembly 32 in a manner described in detail in U.S. Pat. No. 3,927,817. If required during heating of the dies and/or the workpiece to the forming temperature, purge gas from source 38 is flowed through die cavities by closing forming gas valve 40 and opening purge valves 42 and exhaust valves 34, 35. Once the forming temperature is reached, the purging is discontinued by closing purge valves 42. Pressure forming is then initiated by closing valve 34, and opening forming gas valves 39 and 40. Exhaust valve 35 is left open to permit the gas displaced by the forming sheet to flow out of the lower die cavity unrestricted. Motor driven valve 26 is initially closed, and is subsequently opened and closed automatically by the profiling device.

The desired pressure and corresponding time variables are converted to voltage/time values for use by the programmer 20. The programmer 20 is a device for varying the voltage as a function of time in a controlled manner and can consist of a cam driven potentiometer or other programmable profiler devices. This programmed voltage is imposed across the controller 18 which then drives the variable speed motor 24 which operates the pressure valve 26 until the pressure in the line 30 is of the desired level, as indicated through the voltage output of the pressure transducer 22 to the controller 18. Once the voltage output of the transducer 22 equals that of the profiler 20, the variable speed motor 24 is no longer driven and the pressure valve 26 remains at a fixed position. Through this device, the valve 26 will be opened and closed, or its position metered between the open and closed position, as the pressure is below or exceeds, respectively, that desired level as programmed in the profiler 20.

The source of the high pressure gas 28 may be from a pressurized bottle or compressor unit, and the gas may be air or inert as required for the materials and temperatures used in the process. A ballast tank 44 can be used as an aid in smoothing the pressure profile, particularly if the die cavity is quite small. An overflow valve 46 can also be utilized if it is desired to permit pressure decreases during the forming cycle, a requirement commonly found in superplastic forming.

This pressure profiling device can thus impose any desired pressure as a function of time for use in gas pressure forming strain-rate sensitive materials. It will permit the use of an ideal pressure profile to be utilized in a manufacturing operation such that it may be employed repeatedly with precision, free from error or complications of a manual operation. It will, therefore, permit the maximum fabrication rate with a high degree of reliability.

This device will be equally suitable for gas pressure forming sheet materials, or fabrication of more complex parts requiring a combination of diffusion bonding and superplastic forming. For example, the expansion of sandwich structure as described in U.S. Pat. No. 3,927,817 can be accomplished with this device.

Numerous variations and modifications may be made without departing from the present invention. Accordingly, it should be clearly understood that the form of the present invention described above and shown in the accompanying drawings is illustrative only and is not intended to limit the scope of the present invention.

What is claimed is:

1. An apparatus for superplastically forming a part comprising:

a die having a surface which is complementary to the shape of the part;

means for holding in said die at a forming temperature a blank of material which exhibits an effective value of strain rate sensitivity at a forming temperature;

means for automatically applying a gas directly against a surface of said blank to create a pressure across the thickness of a portion of said blank in accordance with a predetermined relationship between time and the pressure required to form said blank against said surface of said die at a strain rate corresponding to said effective value of strain rate sensitivity of said blank.

2. The apparatus as claimed in claim 1, wherein said means for automatically applying pressure comprises:

a programmer which is programmed to follow said predetermined relationship between time and pressure;

a source of high pressure gas;

conduit means coupling said source to said die;

valve means coupled to said conduit means for regulating the flow of high pressure gas between said source and said die;

a pressure transducer coupled to said conduit means for measuring the pressure in said conduit means; and a controller coupled to said programmer to receive command signals from said programmer and coupled to said valve means to control the operation of said valve means in accordance with said programmer, and coupled to said pressure transducer to receive feedback signals from said pressure transducer.

3. The apparatus as claimed in claim 1 including purge gas means coupled to said die to provide a protective atmosphere around said blank during heating of said blank to said forming temperature.

4. The apparatus as claimed in claim 2 including a ballast tank coupled to said conduit means between said die and said valve means.

5. The apparatus as claimed in claim 2, including an overflow valve coupled to said conduit means between said die and said valve means.

* * * * *